US010113468B2

(12) United States Patent
Middleton, Jr.

(10) Patent No.: US 10,113,468 B2
(45) Date of Patent: Oct. 30, 2018

(54) MIXER ASSEMBLY FOR EXHAUST SYSTEMS AND METHOD OF FORMING THE SAME

(71) Applicant: Middleville Tool & Die Co., Middleville, MI (US)

(72) Inventor: Robert Leroy Middleton, Jr., Middleville, MI (US)

(73) Assignee: Middleville Tool & Die Co., Middleville, MI (US)

( * ) Notice: Subject to any disclaimer, the term of this patent is extended or adjusted under 35 U.S.C. 154(b) by 259 days.

(21) Appl. No.: 15/210,324

(22) Filed: Jul. 14, 2016

(65) Prior Publication Data

US 2017/0016373 A1 Jan. 19, 2017

Related U.S. Application Data

(60) Provisional application No. 62/193,995, filed on Jul. 17, 2015.

(51) Int. Cl.
*F01N 3/28* (2006.01)
*B01F 7/00* (2006.01)

(52) U.S. Cl.
CPC ..... *F01N 3/2892* (2013.01); *B01F 7/00141* (2013.01); *B01F 7/00233* (2013.01)

(58) Field of Classification Search
CPC ..... F01N 3/2892
USPC ..... 366/336–338
See application file for complete search history.

(56) References Cited

U.S. PATENT DOCUMENTS 8,511,076 B2 * 8/2013 Wirth ..... B01F 3/04021 60/317
8,745,978 B2 * 6/2014 Vanvolsem ..... B01D 53/90 366/336
2007/0204751 A1 9/2007 Wirth et al.
2008/0267780 A1 * 10/2008 Wirth ..... B01F 3/022 416/204 A
2012/0320708 A1 * 12/2012 Geibel ..... B01F 3/04049 366/337
2015/0016214 A1 * 1/2015 Mueller ..... B01F 5/0616 366/337

* cited by examiner

*Primary Examiner* — David L Sorkin
(74) *Attorney, Agent, or Firm* — Honigman Miller Schwartz and Cohn LLP

(57) ABSTRACT

A mixer assembly of a vehicle exhaust system includes a base tube or pipe section and a plurality of mixing or stirring blades that sequentially engage notches formed in an end or edge portion of the base tube section and interconnect with each other to form a static blade assembly. Each blade of the plurality of mixing blades spans across the interior volume of the base tube section and includes a tab or attachment feature at each of the opposing ends of the respective blade that engages notches on opposing sides of the base tube section. The tabs of the plurality of mixing blades may be coupled with the notches in a manner that prevents disengagement and provides no weld surfaces at an interior volume of the base tube section.

14 Claims, 8 Drawing Sheets

MIXER ASSEMBLY FOR EXHAUST SYSTEMS AND METHOD OF FORMING THE SAME

CROSS-REFERENCE TO RELATED APPLICATION

The present application claims benefit under 35 U.S.C. § 119(e) of U.S. Provisional Application Ser. No. 62/193,995, entitled MIXER ASSEMBLY FOR EXHAUST SYSTEMS AND METHOD OF FORMING THE SAME, filed Jul. 17, 2015, which is hereby incorporated herein by reference in its entirety.

FIELD OF THE INVENTION

The present invention generally relates to mixer assemblies for exhaust systems of internal combustion engines and, more particularly, to a static mixer assembly that is configured to mix the flow of exhaust gases produced by a vehicle engine and a method of forming such a mixer assembly.

BACKGROUND OF THE INVENTION

It is generally known to provide mixing elements arranged in engine exhaust systems upstream a catalytic converter, such as for mixing a gaseous or liquid additive with the exhaust gases to improve reactions and exhaust processing at the catalytic converter, thereby reducing vehicle emissions.

SUMMARY OF THE INVENTION

The present invention provides a mixer assembly of a vehicle exhaust system with a base tube or pipe section and a plurality of mixing or stirring blades that sequentially engage notches formed in an end or edge portion of the base tube section and interconnect with each other to form a static blade assembly. Each blade of the plurality of mixing blades spans across the interior volume of the base tube section (such as across a diameter of a cylindrical tube) and includes a tab or attachment feature at each of the opposing ends of the respective blade that engages notches on opposing sides of the base tube section (such as at an intake end). The tabs of the plurality of mixing blades may be coupled with the notches in a manner that prevents disengagement and provides no weld surfaces at an interior volume of the base tube section.

Also, each blade of the plurality of mixing blades may include a pair of fins that extend toward an opposite or outlet end of the base tube section. The pair of fins are spaced apart or divided proximate the central axis of the base tube section to define a gap or central channel. The pair of fins of each blade are thereby interconnected by an alignment rib arranged at a different location for each of the plurality of mixing blades, allowing the plurality of mixing blades to sequentially engage the base tube with the central channels each receiving at least one alignment rib of the plurality of mixing blades, such as receiving the alignment rib of an adjacent blade so that the alignment ribs together form a generally helical shape. Optionally, the plurality of mixing blades may include a central raised area that protrudes away from the fins to provide each alignment rib with a thickness greater than the proportional axial length of the base tube section (such as greater than a 4 mm thickness for eight blades engaged with a base tube section that has a 30 mm length).

Optionally, the tabs may be attached to the notches by welding at an exterior surface of the base tube section. Optionally, the base tube section may include a locking or deformable feature that is deformable after the plurality of mixing blades are engaged with the base tube section to prevent disengagement of the tabs from the notches (such as deformable into substantial alignment with a circumference of the base tube section to enclose an upper portion of the notch). The deformable portion or locking feature may include a deformable tab or a loop feature that has opposing sides integrally attached to the base tube section In an additional embodiment of the present invention, a method of forming a mixer assembly provides sequentially inserting mixing blades into the interior volume of the base tube section and engaging the tabs at the opposing ends of the respective blade with notches on opposing sides of the base tube section. The tabs of the mixing blades may be coupled with the notches in a manner that prevents disengagement and provides no weld surfaces at the interior volume of the base tube section. When inserting the mixing blades has an alignment rib is received between a divided pair of fins of the previously inserted mixing blade. Optionally, the alignment ribs of each mixing blade may together form a stacked helical arrangement that provides a spiral air passage therethrough. Optionally, the base tube section includes a locking feature that is deformable after the mixing blades are engaged with the base tube section to prevent disengagement of the tabs from the notches, such as a deformable tab or loop feature that may be bent into substantial alignment with a circumference of the base tube section and thereby enclose an upper portion of the notch and to prevent disengagement of the tab therefrom.

These and other objects, advantages, purposes and features of the present invention will become apparent upon review of the following specification in conjunction with the drawings.

DESCRIPTION OF THE PREFERRED EMBODIMENTS

A static mixer assembly may be arranged in an engine exhaust systems upstream a catalytic converter for mixing a gaseous or liquid additive with the flow of exhaust gases to improve reactions and exhaust processing at the catalytic converter, thereby reducing vehicle emissions. For example, a urea solution may be injected into the exhaust system for these benefits; however, it also has a tendency to accumulate on weld surfaces and otherwise unsmooth surfaces. This accumulation in a mixer assembly can reduce the exhaust flow and create excessive pressure in the exhaust system. Also mixer assembly designs with more blades or mixing element or excessive blade angles or mixing element shapes, can similarly reduce the exhaust flow and increase pressure in the exhaust system and against the mixer assembly.

Figure 5:
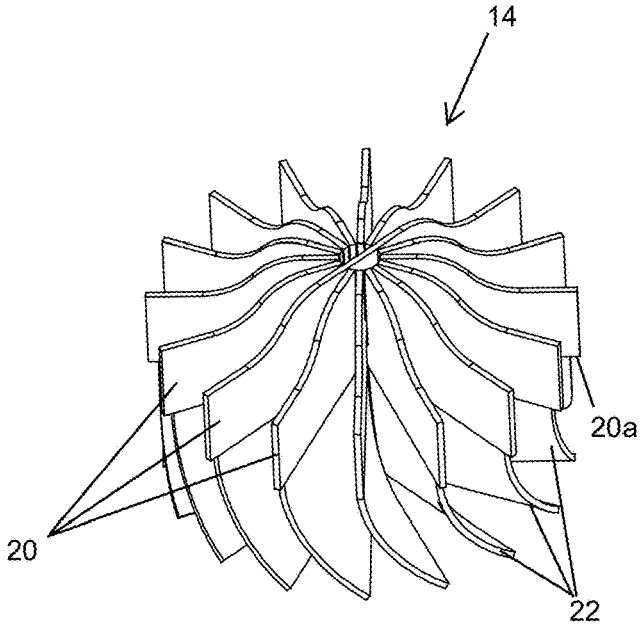
FIG. 5 is a perspective view of the mixing blades assembled separate from the base tube section.

Referring now to the drawings and the illustrative embodiments depicted therein, a mixer assembly 10 of a vehicle exhaust system includes a base tube or pipe section 12 and a plurality of mixing or stirring blades 14 that sequentially engage notches 16 formed in an end or edge portion 18, such as at an intake end 12*a*, of the base tube section 12 and interconnect with each other to form a static blade assembly (FIG. 5). The base tube section 12 provides an interior volume 32 for receiving the blade assembly, which is defined by a curved sidewall with a generally consistent thickness that encloses the interior volume 32 and forms a tubular beam or pipe, such as with a circular or ovular shaped cross section. The base tube section 12 may be roll formed wrapped or pressed from a piece of flat stock metal, may be a cut portion of an elongated pipe, or may otherwise be formed from one or various combinations of metals, composites, ceramics, polymers, or the like.

Figure 8:
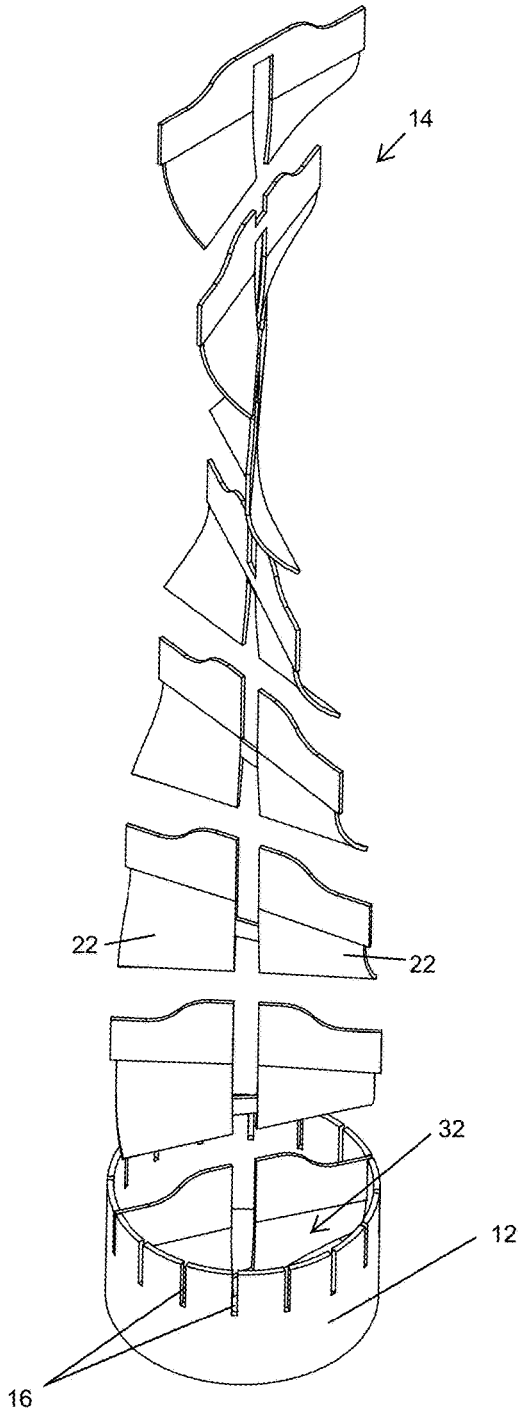
FIG. 8 is an exploded perspective view of the mixer assembly shown in FIG. 7.
Figure 9:
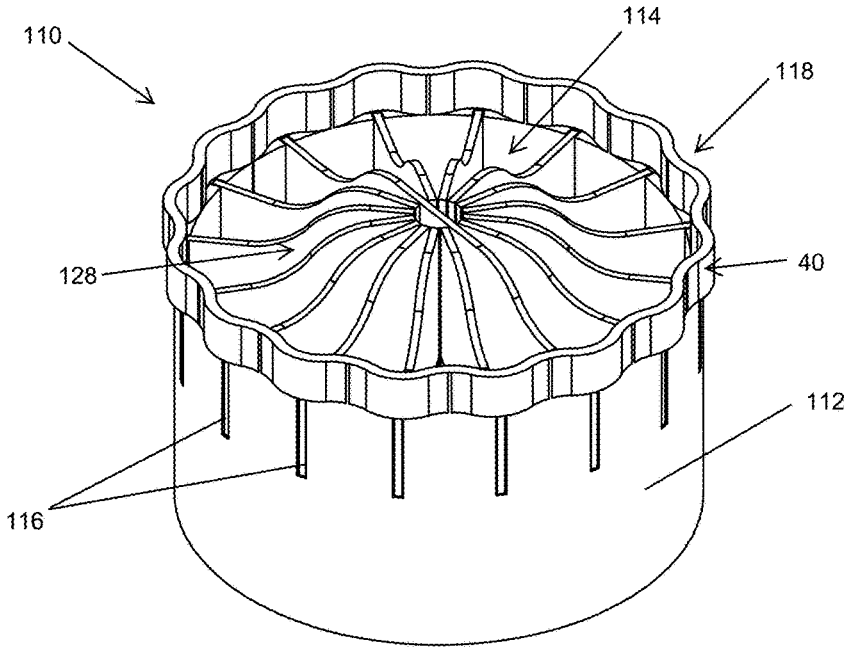
FIG. 9 is a perspective view of a mixer assembly having a locking feature, in accordance with an additional embodiment of the present invention.
Figure 10:
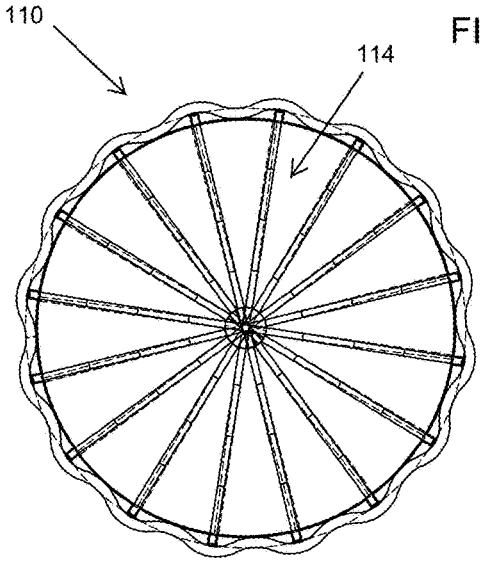
FIG. 10 is a plan view of an end of the mixer assembly shown in FIG. 9, illustrating portions of the mixing blades and base tube section in dashed lines.
Figure 11:
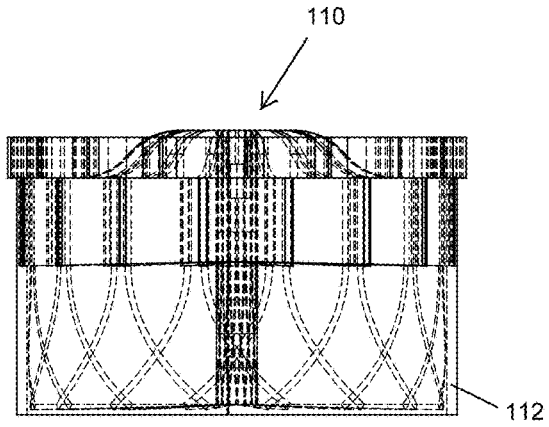
FIG. 11 is a side elevation view of the mixer assembly shown in FIG. 9, illustrating portions of the mixing blades and base tube section in dashed lines.
Figure 12:
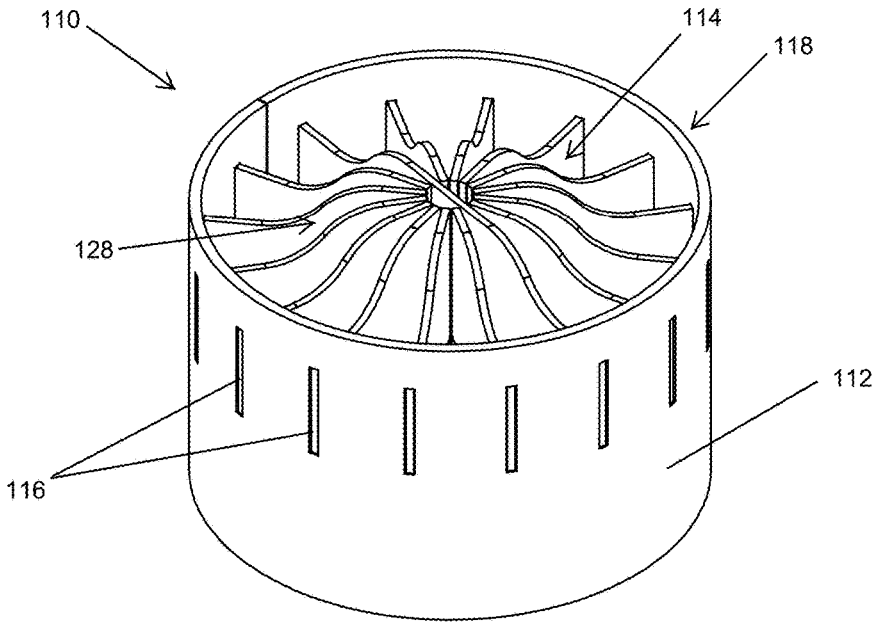
FIG. 12 is a perspective view of the mixer assembly shown in FIG. 9, showing the locking feature deformed to a locked position.
Figure 13:
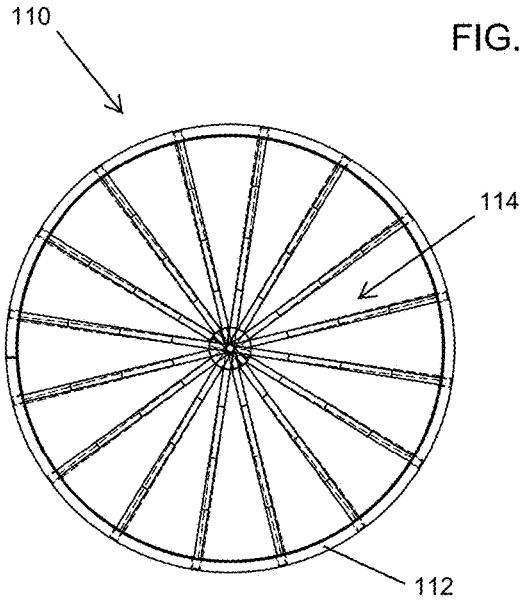
FIG. 13 is a plan view of an end of the mixer assembly shown in FIG. 12, illustrating portions of the mixing blades and base tube section in dashed lines.
Figure 14:
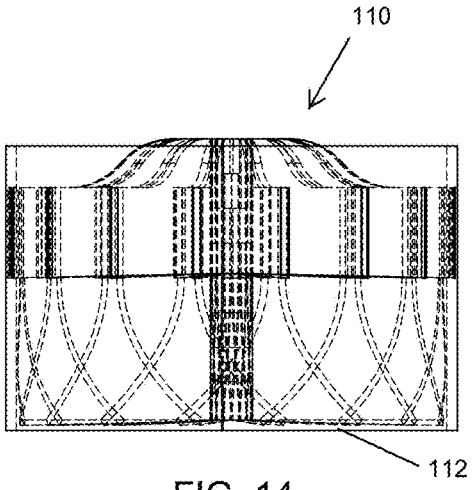
FIG. 14 is a side elevation view of the mixer assembly shown in FIG. 12, illustrating portions of the mixing blades and base tube section in dashed lines.
Figure 15:
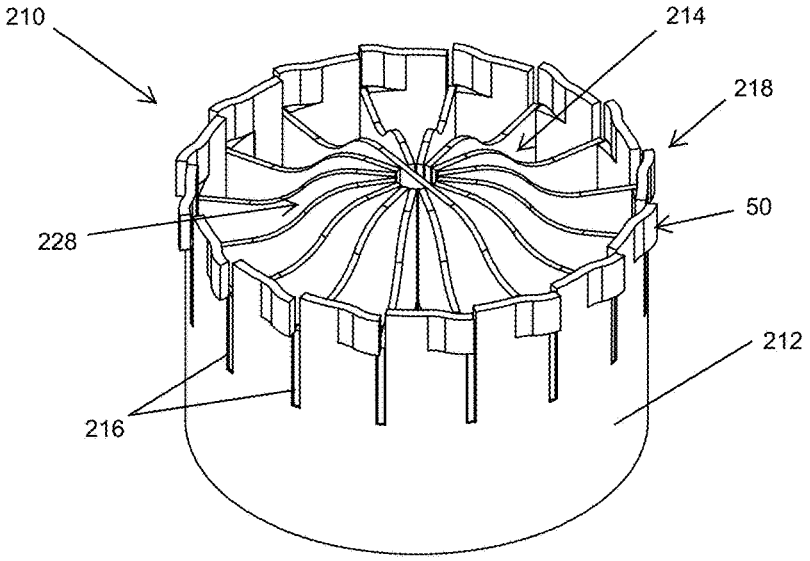
FIG. 15 is a perspective view of a mixer assembly having a different locking feature from that shown in FIG. 11, in accordance with an additional embodiment of the present invention.
Figure 16:
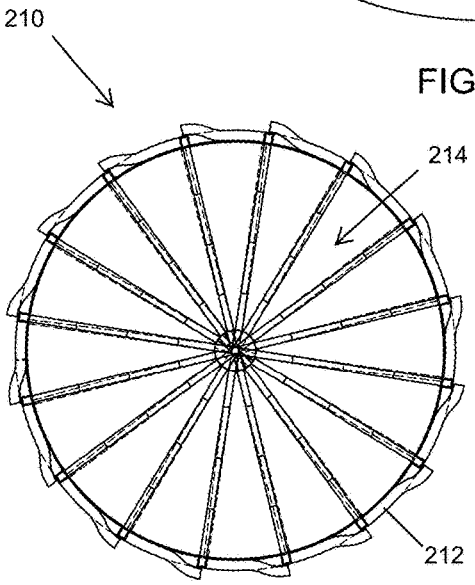
FIG. 16 is a plan view of an end of the mixer assembly shown in FIG. 15, illustrating portions of the mixing blades and base tube section in dashed lines.
Figure 17:
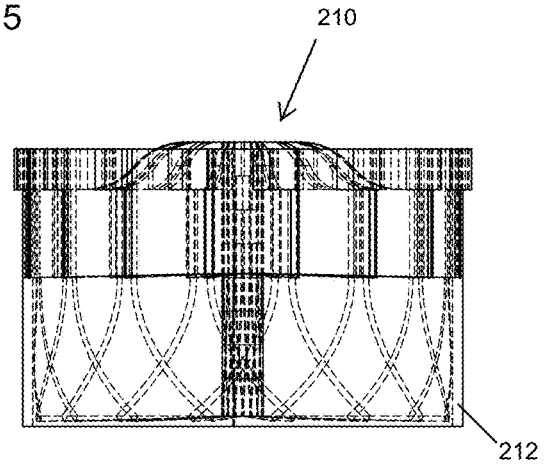
FIG. 17 is a side elevation view of the mixer assembly shown in FIG. 15, illustrating portions of the mixing blades and base tube section in dashed lines.
Figure 18:
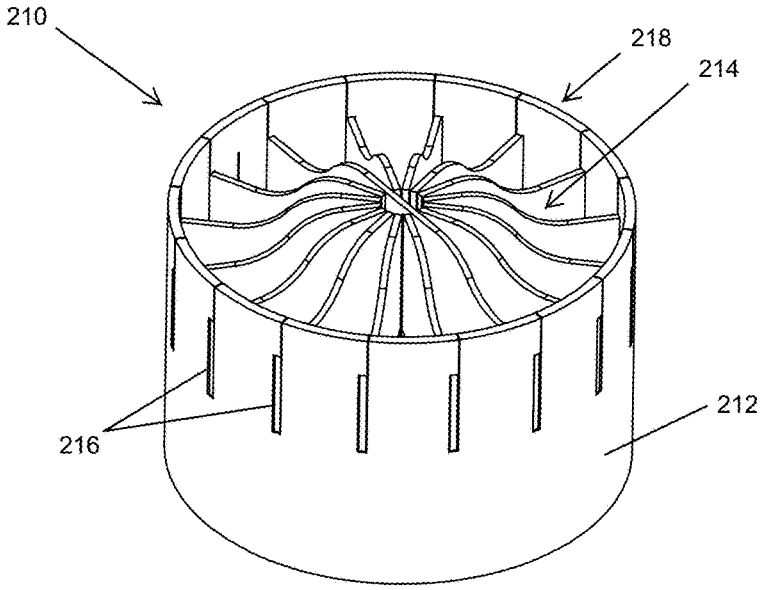
FIG. 18 is a perspective view of the mixer assembly shown in FIG. 15, showing the locking feature deformed to a locked position.
Figure 19:
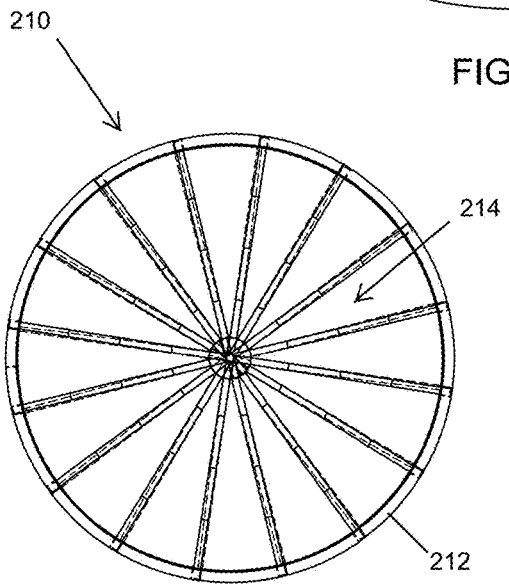
FIG. 19 is a plan view of an end of the mixer assembly shown in FIG. 15, illustrating portions of the mixing blades and base tube section in dashed lines.
Figure 20:
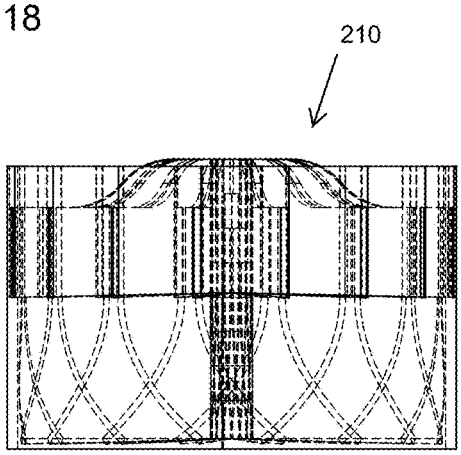
FIG. 20 is a side elevation view of the mixer assembly shown in FIG. 22, illustrating portions of the mixing blades and base tube section in dashed lines.

Each blade of the plurality of mixing blades 14 spans across the interior volume 32 of the base tube section 12, such as across a diameter of a cylindrical tube. Each blade also includes an attachment feature or tab 20 at each of the opposing ends or end portions of the respective blade that engages notches 16 on opposing sides of the base tube section 12. More specifically, the notches 16 may formed in and spaced generally equally around the sidewall of the tub section 12, such as shown in FIG. 8, such that each notch 16 includes a similar notch 16 on the opposite side of the base tube section 12. Each notch 16 may be formed to correspond to the shape of the respective tab 20 on the blade, such as an elongated rectangular shape that is formed in generally linear alignment with the central axis of the base tube section 12, as illustrated. Accordingly, the tabs 20 may have an elongated rectangular shape that slidably mates with the respective notches 16 to slide each blade into engagement with the base tube section 12. An abutment surface 20*a* (FIG. 5) of each tab 20 engages the bottom of each notch 16 when the blade is fully inserted. Upon insertion, an attachment features or tabs 20 of the plurality of mixing blades 14 may be coupled or locked or secured with the notches 16 in a manner that prevents disengagement and provides no weld surfaces at an interior volume of the base tube section, such that there is reduce urea or other additive or exhaust compound accumulation on the blade assembly and interior volume of the base tube section.

Figure 7:
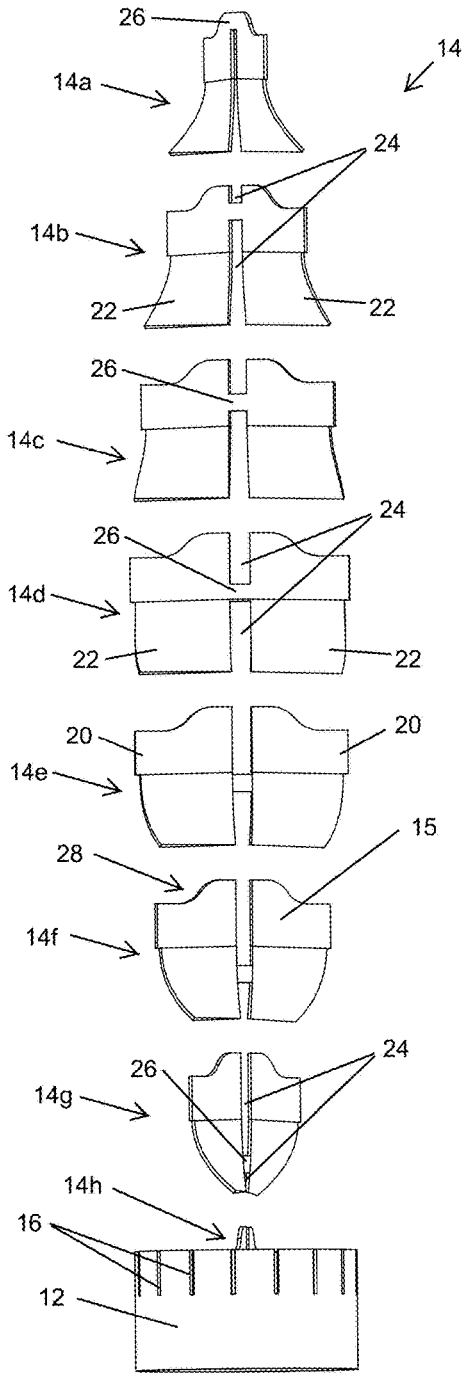
FIG. 7 is an exploded side elevation view of the mixer assembly, having a single mixing blade engaged with the base tube section.

Also generally referring to the illustrative embodiments, each blade of the plurality of mixing blades 14 may include a pair of fins 22 that extend toward an opposite or outlet end 12*b* of the base tube section 12. The pair of fins 22 are spaced apart or divided proximate a central axis of the base tube section 12 to define a gap or central channel 24. Each of the pair of fins 22 has an opposite angle or curvature from the other fin on the blade 14. The fins 22, as illustrated in FIGS. 7 and 8, extend from in a generally planar base portion 15 of the blade 14 with a lesser thickness than the base portion 15. The pair of fins 22 of each blade are thereby interconnected by an alignment rib 26 that is arranged at a different location for each of the plurality of mixing blades 14, such as between the fins 22 or between the base portion 15. The differently located alignment ribs 26 (FIG. 7) allows the plurality of mixing blades to sequentially engage the base tube section 12 in an interconnected and stacked arrangement. More specifically, the alignment ribs 26 are arranged as follows: for the first mixing blade 14*h* the alignment rib 26 is at the lower end between the fins 22; for the second mixing blade 14*g* the alignment rib 26 is between the fins 22 at a location higher by a distance substantially equal to the thickness of the alignment rib on the first mixing blade 14*h*; for the third mixing blade 14*f* the alignment rib 26 is between the fins 22 at a location higher by a distance substantially equal to the thickness of the alignment rib on the second mixing blade 14*g*; for the fourth mixing blade 14*e* the alignment rib 26 is between the fins 22 at a location higher by a distance substantially equal to the thickness of the alignment rib on the third mixing blade 14*f*; for the fifth mixing blade 14*d* the alignment rib 26 is between the base portion 15 at a location higher by a distance substantially equal to the thickness of the alignment rib on the fourth mixing blade 14*d*; for the sixth mixing blade 14*c* the alignment rib 26 is between the base portion 15 at a location higher by a distance substantially equal to the thickness of the alignment rib on the fifth mixing blade 14*d*; for the seventh mixing blade 14*b* the alignment rib 26 is between the base portion 15 at a location higher by a distance substantially equal to the thickness of the alignment rib on the sixth mixing blade 14*c*; and for the eighth mixing blade 14*a* the alignment rib 26 is between the base portion 15 at a location higher by a distance substantially equal to the thickness of the alignment rib on the seventh mixing blade 14*b*. In doing so, the central channels 24 each receiving at least one alignment rib 26 of the plurality of mixing blades 14, such as receiving the alignment rib 26 of an adjacent blade so that the alignment ribs may together form a generally helical or stepped spiral shape.

As shown in FIGS. 1-4, the plurality of mixing blades 14 may include a central raised area 28 that protrudes axially away from the fins 22. The raised area 28 is formed by an intermediate portion of each blade that extends, such as in a curved shape, along the edge of the blade distal from the fins 22. The raised area 28 provides added geometry for each alignment rib 26 to have a thickness greater than the proportional axial length of the base tube section 12. As illustrated, the raised area 28 allows the each alignment rib of the eight blades shown to have a generally 5 mm thickness, such that when engaged the length at the raised area is generally 40 mm, compared to the illustrated base tube section that has a axial length of generally 30 mm (which would otherwise have a proportional length for each alignment rib of about 3.75 mm). The added thickness of each alignment rib 26 provided by the raised area 28 allows the tube section to be packaged in a smaller section, while providing the desired fin length and angular shape.

Figure 6:
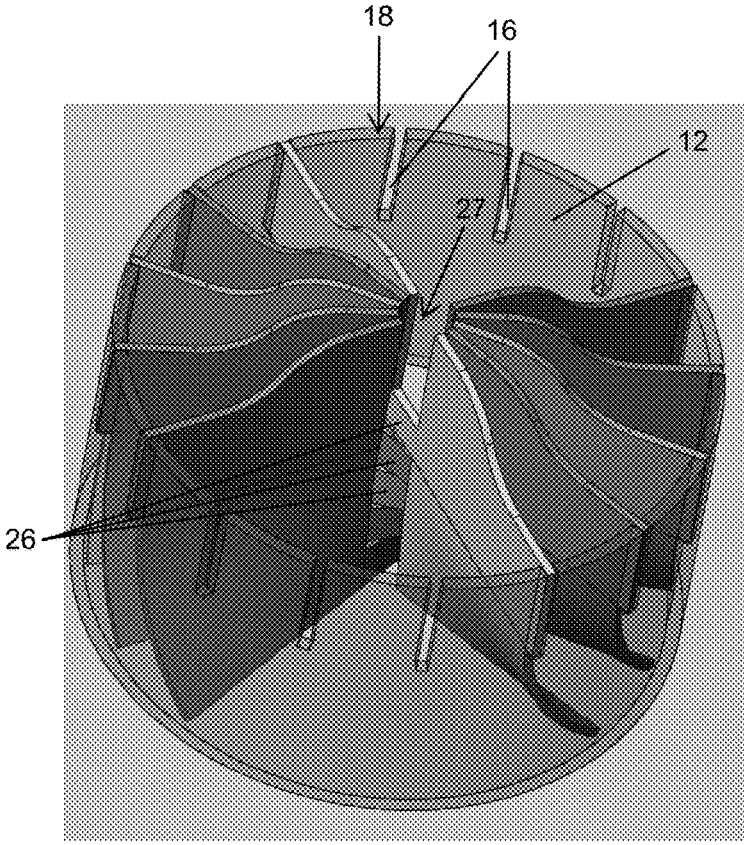
FIG. 6 is a perspective view of the mixer assembly, illustrating some of the mixing blades removed or not assembled with the base tube section and the base tube section in translucent shading to show fins of the assembled mixing blades.

To form or otherwise assemble the mixer assembly, as shown in FIGS. 6-8, each blade 14*a*-14*h* of the plurality of mixing blades 14 is sequentially inserted into the interior volume 32 of the base tube section 12, such as in the illustrated order of separated blades. Upon insertion, the tabs 20 at the opposing ends of the respective blade 14 slidably and matably engage in the notches 16 on opposing sides of the base tube section 12. The tabs 20 of the mixing blades may be coupled with the notches 16 in a manner that prevents disengagement and provides no weld surfaces at the interior volume of the base tube section. When inserting the mixing blades, an alignment rib 26 is received between a divided pair of fins 22 of the previously inserted mixing blade 14. The alignment ribs 26 of each mixing blade may together form a stacked helical arrangement that provides a spiral air passage 27 (FIG. 6), which is defined by the central channels 24 around the alignment ribs 26, as shown in FIGS. 7 and 8.

The tabs 20 for each blade 14 may be attached or secured or joined within the notches 16 at an exterior surface 30 of the base tube section 12, as contemplated for the embodiment illustrated in FIGS. 1-8. The joining may be done by welding, such as with frictional stir welding, arc welding, or the like, or the joining may be done with other forms of fasteners, adhesive, or the like to secure the blade assembly to the base tube section 12 in a manner that does not provide weld surface on the interior volume 32 (FIG. 8) of the pipe section 12.

In other embodiments, the base tube section may include a locking feature that is deformable after the mixing blades are engaged with the base tube section to prevent disengagement of the tabs from the notches, such as a loop feature 40 (FIGS. 9-14) or a deformable tab 50 (FIGS. 15-20). The locking feature in both illustrated embodiments includes a deformable portion at an upper portion of the notch 116, 216, where the deformable portion may be bent toward or away from the interior volume of the base tube section 112, 212 to expose an insertion end of the notch at an upper portion thereof. The respective tab 120, 220 of a blade be inserted past the deformable portion and engage the notch 116, 216, and after being inserted, the deformable portion may be bent or deformed into substantial alignment with a circumference of the base tube section 112, 212 to enclose the notch and to prevent disengagement of the tab therefrom. In these embodiments, substantially identically features described above have been referenced with like reference numbers increase by 100 for FIGS. 9-14 and by 200 for FIGS. 15-20, such that the description provided above is applicable to these feature, unless specified to the contrary.

The base tube section 112 may include a locking or deformable feature that is deformable after the plurality of mixing blades are engaged with the base tube section to prevent disengagement of the tabs from the notches (such as deformable into substantial alignment with a circumference of the base tube section to enclose an upper portion of the notch). In FIGS. 9-14, the deformable portion or locking feature includes a deformable loop feature that has opposing sides integrally attached to the base tube section 112. The loop feature may be bent radially outward proximate the upper end of each notch 116, such that the loop feature 40 defines an undulating curvature or wave shape that surrounds circumference of the base tube section 112 at the intake end thereof. After inserting each blade, the loop feature 40 may be deformed into substantial alignment with the circular circumference of the mid portion of the base tube section 112 to enclose the upper portion of each notch and to prevent disengagement of the tabs therefrom.

With reference to FIGS. 15-20, the deformable portion or locking feature includes a deformable tab 50 with a single side integrally attached to the base tube section 212 and the opposing free side (formed in alignment with the notch 216) bent radially outward away from the base tube section 212. The deformable tab 50 may be bent radially outward proximate the upper end of each notch 216, such that the deformable 50 pivots outward about a pivot axis generally parallel with the central axis of the base tube section 212 at the intake end thereof. After inserting each blade, the deformable tab 50 may be deformed into substantial alignment with the circular circumference of the mid portion of the base tube section 212 to enclose the upper portion of each notch and to prevent disengagement of the tabs therefrom With further reference to the method of forming the mixer assembly, the plurality of notches may be formed around an end portion of the base tube section by stamping, laser cutting, grinding, cutting, punching, or the like. The same formation process for the notches may also be used to form the deformable portion or locking feature, if present.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

Figure 1:
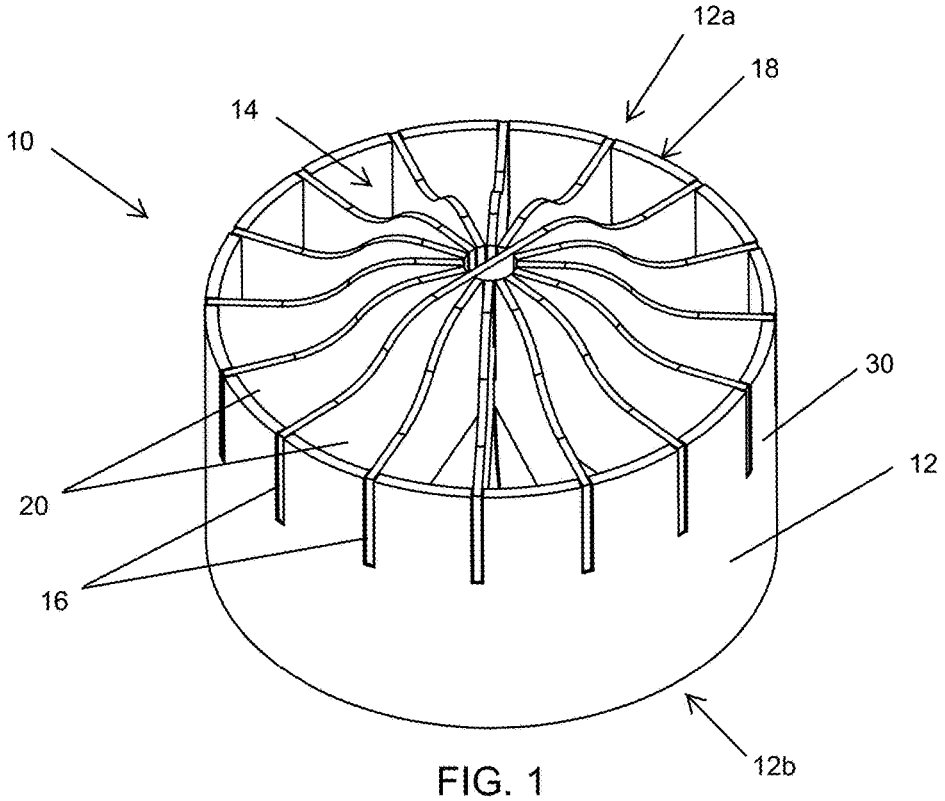
FIG. 1 is an upper perspective view of a mixer assembly with mixing blades engaged with notches formed in a base tube section, in accordance with an embodiment of the present invention.
Figure 2:
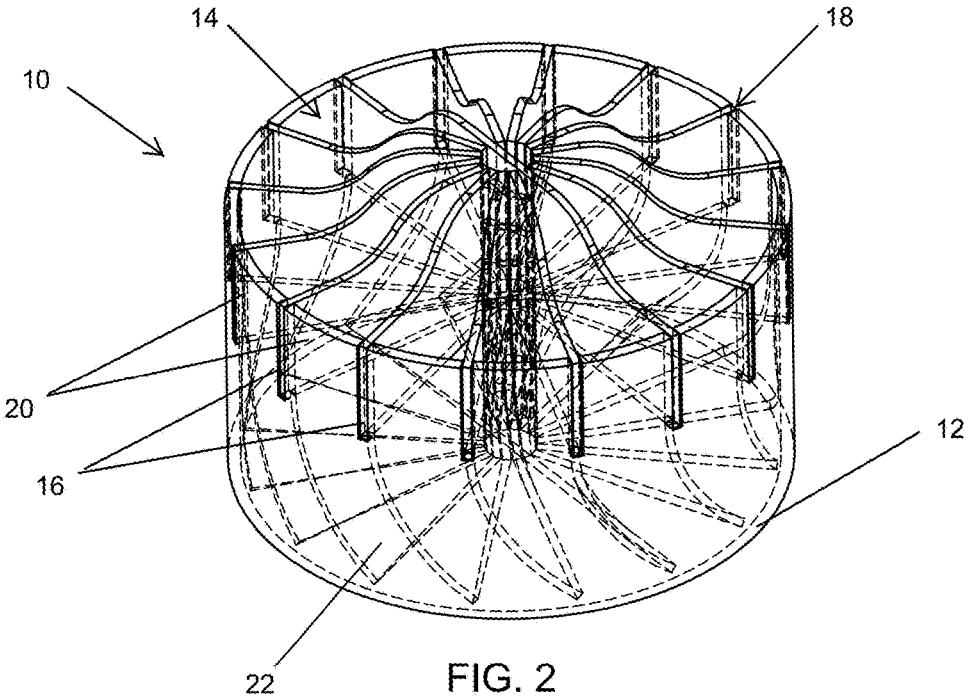
FIG. 2 is an upper perspective view of the mixer assembly shown in FIG.1, illustrating portions of the mixing blades and base tube section in dashed lines.
Figure 3:
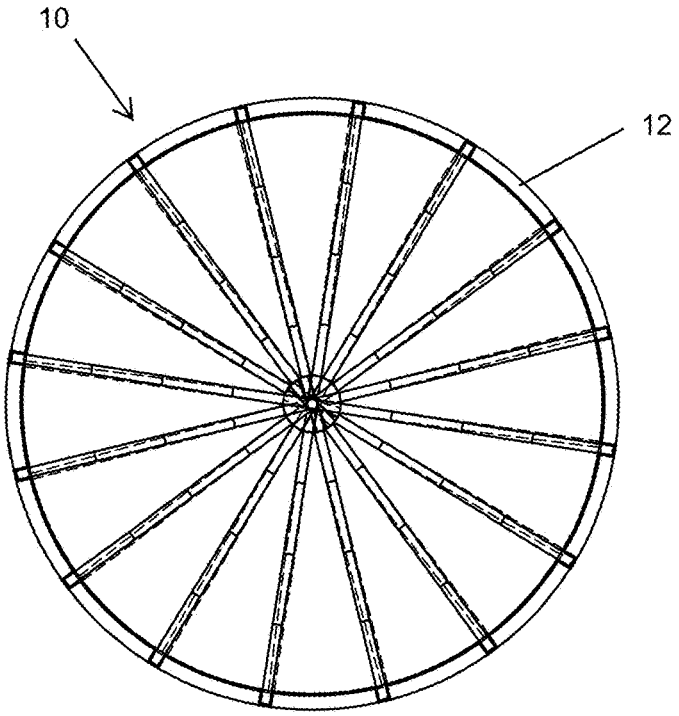
FIG. 3 is a plan view of an end of the mixer assembly shown in FIG.1, illustrating portions of the mixing blades and base tube section in dashed lines.
Figure 4:
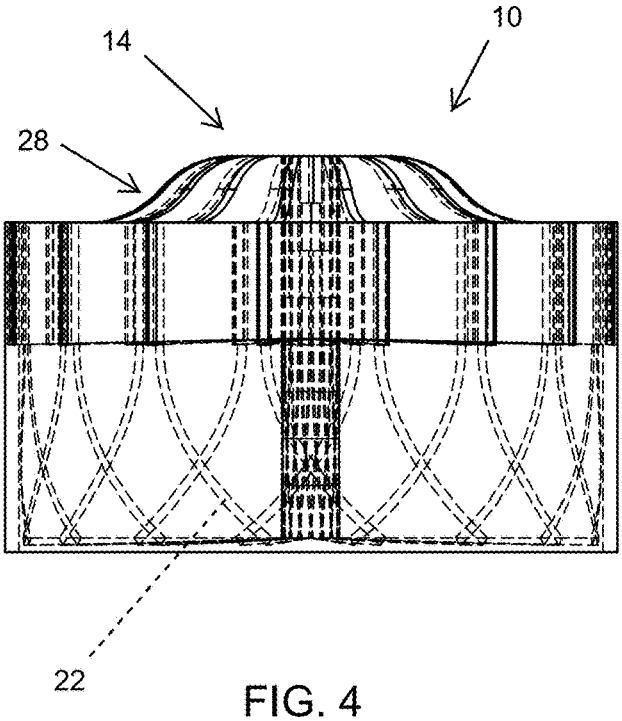
FIG. 4 is a side elevation view of the mixer assembly shown in FIG.1, illustrating portions of the mixing blades and base tube section in dashed lines.

For purposes of this disclosure, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature; may be achieved with the two components (electrical or mechanical) and any additional intermediate members being integrally formed as a single unitary body with one another or with the two components; and may be permanent in nature or may be removable or releasable in nature, unless otherwise stated.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A mixer assembly of a vehicle exhaust system, said mixer assembly comprising:

a base tube section having a plurality of notches formed in an intake end of the base tube section and spaced around a periphery of the intake end;

a blade assembly comprising a plurality of mixing blades disposed in an interior volume of the base tube section;

wherein each blade of the plurality of mixing blades spans across the interior volume of the base tube section and includes a tab at each of the opposing ends of the respective blade that engages a notch of the plurality of notches;

wherein each blade of the plurality of mixing blades includes a pair of fins that extend toward an outlet end of the base tube section and that are spaced apart to define a central channel;

wherein the pair of fins on each blade of the plurality of mixing blades are interconnected by an alignment rib that spans across the central channel; and wherein the alignment rib of each blade is arranged at a different location from the other blades for the plurality of mixing blades to sequentially engage the base tube with the central channels each receiving at least one alignment rib of the plurality of mixing blades.

2. The mixer assembly of claim 1, wherein the plurality of mixing blades sequentially engage the base tube with the central channels each receiving the alignment rib of an adjacent blade, such that the alignment ribs together forming a generally helical shape.

3. The mixer assembly of claim 1, wherein the tabs are attached to the notches by welding at an exterior surface of the base tube section.

4. The mixer assembly of claim 1, wherein the base tube section includes a locking feature that is deformable after the plurality of mixing blades are engaged with the base tube section to prevent disengagement of the tabs from the notches.

5. The mixer assembly of claim 1, wherein the base tube section includes a deformable portion at a notch of the plurality of notches, wherein the deformable portion is bent toward or away from the interior volume of the base tube section to expose an insertion end of the notch to allow the tab of a blade be inserted past the deformable portion and engage the notch, and wherein said deformable portion is deformable into substantial alignment with a circumference of the base tube section to enclose the notch and prevent disengagement of the tab therefrom.

6. The mixer assembly of claim 5, wherein the deformable portion includes a deformable tab.

7. The mixer assembly of claim 5, wherein the deformable portion includes a loop feature having opposing sides integrally attached to the base tube section.

8. A mixer assembly of a vehicle exhaust system, said mixer assembly comprising:

a base tube section having a plurality of notches formed around an end portion of the base tube section;

a plurality of mixing blades, wherein each blade of the plurality of mixing blades has a tab at opposing ends of the respective blade that engages a notch of the plurality of notches, thereby arranging each blade to extend across a diameter of the base tube section;

wherein each blade of the plurality of mixing blades includes a pair of fins that are divided by a central channel and interconnected by an alignment rib; and wherein the plurality of mixing blades are configured to sequentially engage the base tube section, such that the central channel of each blade receives the alignment rib of an adjacent blade.

9. The mixer assembly of claim 8, wherein the tabs of the plurality of mixing blades are coupled with the notches in a manner that prevents disengagement and provides no weld surfaces at an interior volume of the base tube section.

10. The mixer assembly of claim 8, wherein the tabs are attached to the notches by welding at an exterior surface of the base tube section, and wherein the plurality of mixing blades include a central raised area that protrudes away from the fins.

11. The mixer assembly of claim 8, wherein the alignment ribs together forming a stacked helical arrangement that provides a spiral air passage through the central channels.

12. The mixer assembly of claim 8, wherein the base tube section includes a locking feature that is deformable after the plurality of mixing blades are engaged with the base tube section to prevent disengagement of the tabs from the notches.

13. The mixer assembly of claim 8, wherein the base tube section includes a deformable tab at each notch that is deformable into substantial alignment with a circumference of the base tube section to enclose an upper portion of the notch and to prevent disengagement of the tab therefrom.

14. The mixer assembly of claim 8, wherein the base tube section includes a loop feature having opposing sides integrally attached at an upper portion of each notch, and wherein the loop feature is configured to be deformed into substantial alignment with a circumference of the base tube section to enclose the upper portion of each notch and to prevent disengagement of the tabs therefrom.

* * * * *